US008369556B2

(12) United States Patent
Power

(10) Patent No.: US 8,369,556 B2
(45) Date of Patent: Feb. 5, 2013

(54) MICROPHONE POP FILTER

(76) Inventor: Robert Power, New York, NY (US)

( * ) Notice: Subject to any disclaimer, the term of this patent is extended or adjusted under 35 U.S.C. 154(b) by 272 days.

(21) Appl. No.: 12/839,825

(22) Filed: Jul. 20, 2010

(65) Prior Publication Data

US 2012/0020511 A1 Jan. 26, 2012

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl. ..... 381/359; 381/355; 381/356

(58) Field of Classification Search ..... None
See application file for complete search history.

(56) References Cited

U.S. PATENT DOCUMENTS

| | | | | |
|---|---|---|---|---|
| 4,212,219 | A * | 7/1980 | Hubbard | 84/723 |
| 5,740,262 | A * | 4/1998 | Yoshida et al. | 381/361 |
| 5,808,243 | A * | 9/1998 | McCormick et al. | 181/0.5 |
| 7,415,122 | B2 * | 8/2008 | Soutar et al. | 381/189 |
| 7,945,063 | B2 * | 5/2011 | Soutar et al. | 381/189 |
| 8,157,049 | B1 * | 4/2012 | Meyer et al. | 181/199 |
| 2005/0169489 | A1 * | 8/2005 | Cleckler et al. | 381/113 |
| 2005/0254666 | A1 * | 11/2005 | Michael | 381/72 |
| 2007/0003095 | A1 | 1/2007 | Slamka et al. | |
| 2008/0118096 | A1 * | 5/2008 | De Pooter et al. | 381/359 |
| 2012/0020511 | A1 * | 1/2012 | Power | 381/352 |

FOREIGN PATENT DOCUMENTS

| | | | |
|---|---|---|---|
| JP | 2008-048309 | * | 2/2008 |
| WO | WO 2010133812 A1 | * | 11/2010 |

OTHER PUBLICATIONS

Jon Cotton, "Ribbon Microphones on Test," Sound on Sound, Nov. 2007, http://www.soundonsound.com/sos/nov07/articles/ribbonmics1.htm.

Blue Microphones, The Pop Universal Pop Filter, http://www.bluemic.com/store/index.php?crn=209&rn=391&action=sho.

* cited by examiner

*Primary Examiner* — Marlo Fletcher

(74) *Attorney, Agent, or Firm* — Wood, Herron & Evans LLP

(57) ABSTRACT

A microphone pop filter for attenuating plosive artifacts utilizes a substantially acoustically transparent material configured to define multiple airfoil surfaces that are oriented non-orthogonally relative to an axis defined between an audio source and a microphone diaphragm, with the substantially acoustically transparent material disposed intermediate the audio source and the microphone diaphragm and separated from the microphone diaphragm by an airspace. Plosive artifacts from the audio source may be deflected away from the microphone diaphragm by the airfoil surfaces to reduce the impact of such artifacts on the microphone diaphragm and the resulting electronic signal output therefrom.

25 Claims, 6 Drawing Sheets

MICROPHONE POP FILTER

FIELD OF THE INVENTION

The invention relates to pop filters and windscreens used to reduce pops and wind noise picked up by a microphone.

BACKGROUND OF THE INVENTION

Microphones are transducers; assemblies that convert one form of energy into another. In the case of microphones, they convert sound waves—periodic displacements of pressure in air—into electrical impulses. These impulses are then used in electronic reproduction of the original sound. Microphones operate utilizing a diaphragm, typically a flat disc that reacts to pressure changes in the air. The sound to be reproduced creates periodic waves in the air, which displaces the diaphragm from its resting place. The diaphragm, housed in what is commonly referred to as a capsule, acts as the first stage of the transducer, converting physical air pressure changes in the form of sound waves, into electrical impulses via a variety of methods.

Most modern vocal recording is done with the singer or announcer within six inches or less of the microphone. This often creates unwanted artifacts that occur when plosives (e.g., hard consonants such as p's, b's) from the singer or announcer's mouth result in bursts of air that, when they reach the diaphragm, cause it to travel in such a way that creates distortion of the desired sound. This is manifested to the listener as a low frequency pop or hump sound emanating from the electronic reproduction audio system. This is considered disruptive to the listener, as it is not an element that would be present acoustically if the listener was within physical proximity to the singer or announcer such that they could hear the sounds from the performer's mouth without the aid of an electronic reproduction system.

Conventional attempts to mitigate unwanted artifacts from a singer or announcer rely on the use of pop filters, or windscreens, of various constructions. There are several, often competing considerations in the design and construction of microphone pop filters. First, an apparatus should be as effective as possible in diminishing the negative artifacts of plosive consonants resulting from microphone positioning close to a vocal performer's mouth. Second, an apparatus should cause the fewest anomalies possible in the fidelity of the recording through said microphone. While microphones and electronic reproduction systems themselves do not approach the characteristics of human hearing of the same source in an acoustic environment, one measure of the overall quality of said apparatus is its sonic transparency. Put another way, the frequency response of the receiving microphone should not be altered significantly from that which would occur without the plosive reduction apparatus.

The first consideration can be measured by recording and measuring the amplitude of plosive consonants without the apparatus, then doing the same with the apparatus in place between the audio source (e.g., vocalist or announcer) and the microphone. This may be normally represented as a simple x-y graph, where x is a horizontal axis representing time and y is a vertical axis representing amplitude.

The second consideration—fidelity of frequency response—can be measured by recording and graphically representing the frequency response of a given acoustic source through the microphone and recording apparatus, then doing the same with the plosive reduction apparatus in place between the sound source (vocalist) and the microphone. A comparison of these two resultant graphs provides a measurement of the degree of anomalies introduced by the insertion of the plosive reduction apparatus between the sound source and the microphone. There are several methods of representing this graphically; one in which the sound as received through the transducer (microphone) is an x-y graph where x is the horizontal axis representing the spectrum (in cycles per second, or hertz) of human hearing, and y is the vertical axis representing the amplitude of those frequencies in relation to each other at one moment in time. The second method of graphic representation is a spectrogram, a three dimensional graphic representation of the sound received through the transducer (microphone), where the x axis represents frequency, the y axis represents amplitude, and the z axis represents time. In the case of a plosive filter, the first representation is adequate, as the plosive is typically representative of a relatively short (approximately 5 millisecond) period of time.

Conventional devices incorporate several different methodologies for shielding a microphone diaphragm from the distortion-causing burst of air or wind created from a sung or spoken plosive consonant. One conventional design incorporates a baffle system that is integral to the microphone capsule assembly. In such a construction, a series of physical baffles between the receiving end of the capsule and the diaphragm create a twisting path that acts as a series of barriers, around which the sound wave must travel to reach the diaphragm. In theory, the excess displacement of air resulting in the unwanted distorted plosive is dissipated by the series of baffles, yet the open spaces around the baffles allow the desired normal sound waves to pass through to the capsule and diaphragm.

A second type of design is made of open cell foam. This can be either an integral part of the capsule assembly or an external piece of foam in a variety of shapes with a hollow area into which the microphone is inserted. In theory, the network of foam cells acts as a complex baffle, which prevents the excess displacement of air from a plosive from reaching the microphone diaphragm, yet still allows the desired normal sound waves to pass through to the capsule and diaphragm.

A third type of design is an external hoop and fabric type, consisting of one or more layers of a permeable fabric such as Lycra or spandex that is stretched over a hoop-shaped frame. The fabric is held in place by a system of tightly-fitting concentric hoops, with the fabric edges secured by the pressure between the two hoops. This hoop assembly is attached to the microphone or to a microphone stand by a length of coiled metal whose shape retention allows the user to place the hoop type screen between the mouth of the singer or announcer and the capsule and diaphragm of the microphone. The hoop is affixed to one end of the length of coiled metal, commonly referred to as a "gooseneck." The other end of this gooseneck incorporates a clip, which is affixed to the microphone body, or the microphone stand. The fabric covered hoop is positioned with the flat face of the hoop assembly facing the vocalist's mouth, so the sound waves resulting in air pressure changes hit the flat surface of the stretched fabric at a 90° angle. In theory, the unwanted excess air movement created by a plosive is reflected and dissipated by the fabric, yet the fabric is permeable to the point that the desired sound waves pass through to the capsule and diaphragm.

Although the hoop type of pop filter or windscreen is commonly accepted to be the most efficient of the three types, providing the greatest amount of plosive artifact reduction while affording the highest fidelity of the sound that does reach the diaphragm, it has been found that this design is moderately effective, at best. Further, if the vocalist is too close (e.g., two inches or less) from the device, or if the device is too close to the microphone capsule, the device loses most of its effectiveness in reducing plosive distortion. One remedy for this—in practical use for some time—is the use of two of these hoop screens in succession, with a small airspace separating them. These are now being commercially manufactured in this dual configuration; however, it has been found that their effectiveness is still not optimal.

Therefore, a significant need continues to exist in the art for an improved device and methodology for attenuating plosive artifacts from an audio source such as a singer or announcer.

SUMMARY OF THE INVENTION

The invention addresses these and other problems associated with the prior art by providing a pop filter configuration in which a substantially acoustically transparent material is utilized to define multiple airfoil surfaces that are oriented non-orthogonally relative to an axis defined between an audio source and a microphone diaphragm, with the substantially acoustically transparent material disposed intermediate the audio source and the microphone diaphragm and separated from the microphone diaphragm by an airspace.

In particular, it is believed that a fundamental physical flaw exists in conventional designs, such as hoop-type pop filters, due to the substantially orthogonal orientation of such devices relative to both the audio source and the microphone diaphragm. It is further believed that by providing multiple, non-orthogonal airfoil surfaces, spaced apart from a microphone diaphragm, plosive artifacts from an audio source may effectively be deflected away from the microphone diaphragm, and thus reduce the impact of such artifacts on the microphone diaphragm and the resulting electronic signal output therefrom.

Therefore, consistent with one aspect of the invention, a microphone pop filter for attenuating plosive artifacts from an audio source includes a substantially acoustically transparent material configured in use to be disposed intermediate the audio source and a microphone diaphragm and spaced away from the microphone diaphragm so as to provide an airspace therebetween, and at least two airfoil surfaces defined by at least two portions of the substantially acoustically transparent material, each airfoil surface oriented non-orthogonally relative to an axis defined between the audio source and the microphone diaphragm to deflect plosive artifacts from the audio source away from the microphone diaphragm.

Consistent with another aspect of the invention, a microphone pop filter includes a substantially acoustically transparent material supported by a support structure to define at least one generally conic airfoil surface extending along an axis from an apex of the conic airfoil surface to a base thereof, and a mount coupled to the support structure and configured to orient the substantially acoustically transparent material intermediate the audio source and a microphone diaphragm with the apex facing the audio source, with the mount further configured to orient the substantially acoustically transparent material spaced away from the microphone diaphragm so as to provide an airspace therebetween.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

DETAILED DESCRIPTION

Embodiments consistent with the invention attenuate plosive artifacts from an audio source using a substantially acoustically transparent material configured in use to be disposed intermediate an audio source and a microphone diaphragm and spaced away from the microphone diaphragm so as to provide an airspace therebetween, and at least two airfoil surfaces defined by at least two portions of the substantially acoustically transparent material, with each airfoil surface oriented non-orthogonally relative to an axis defined between the audio source and the microphone diaphragm to deflect plosive artifacts from the audio source away from the microphone diaphragm.

In particular, it is believed that a fundamental physical flaw exists in conventional pop filter designs, such as hoop-type, or planar, pop filters, due to the substantially orthogonal orientation of such devices relative to both the audio source and the microphone diaphragm. It is believed that the unwanted air explosion from a plosive addresses the surface of a conventional planar pop filter at about a 90° angle, which is equivalent to an automobile hitting a flat wall, head on. It is further believed that the transparency/permeability of the material, which is necessary to provide an appropriate frequency response and avoid muffling or otherwise altering the output of the audio source, combined with the orientation of the orthogonal surface, allows much of the energy of the plosive to pass directly through the pop filter, relatively unimpeded. Embodiments consistent with the invention, on the other hand, effectively redirect the energy of a plosive away from a microphone diaphragm using multiple non-orthogonal airfoil surfaces so the energy can dissipate in multiple directions into the air with little or no effect on the diaphragm. Further, in some embodiments, a cone shaped pop filter may be used to create an airfoil that effectively diverts the unwanted energy from the plosive into a theoretically infinite number of directions, thus further reducing the amount of such unwanted energy reaching the diaphragm.

Figure 1:
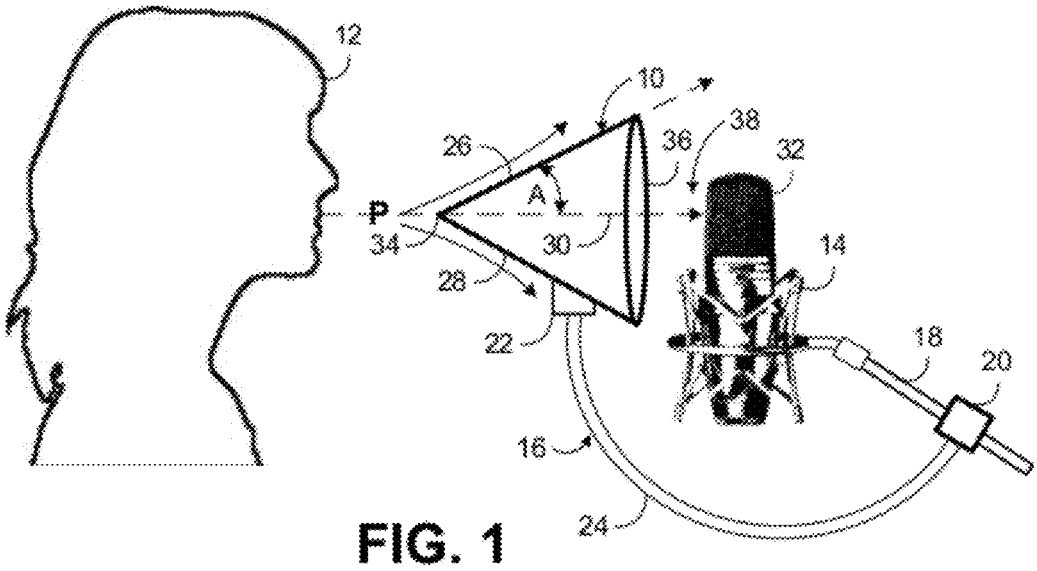
FIG. 1 is a functional diagram illustrating one implementation of a pop filter consistent with the invention.

Turning to the drawings, wherein like numbers denote like parts throughout the several views, FIG. 1 illustrates a microphone pop filter 10 consistent with the principles of the invention. Pop filter 10, in use, is configured to be positioned between an audio source 12, e.g., a human singer, announcer, speaker or any other source of audio the may generate plosive artifacts, and a microphone 14, such that any plosive artifacts will be attenuated by the pop filter 10 before reaching the microphone 14, thereby improving the fidelity of the electronic signal output by the microphone.

Pop filter 10 may be secured in the intermediate position in a number of manners consistent with the invention. As shown in FIG. 1, for example, a mount 16 may be used to secure pop filter 10 to a microphone stand 18, with cooperating clamps 20, 22 disposed at opposite ends of a gooseneck 24 and respectively secured to microphone stand 18 and pop filter 10. In other embodiments, alternative mounts may be used to properly position pop filter 10. For example, a pop filter may be secured directly to a microphone, secured to a shock mount for the microphone, secured to other structures within a studio, or supported by a separate stand. Furthermore, alternative mount designs, e.g., as used for conventional planar pop filters, may also be used to secure pop filter 10 in a fixed position. The invention is therefore not limited to the particular mounting configurations disclosed herein.

In the embodiment illustrated in FIG. 1, pop filter 10 is substantially acoustically transparent, such that sonic characteristics of the audio from audio source 12 (with the exception of any plosive artifacts) are not appreciably altered by pop filter 10, thereby preserving the fidelity of the signal captured by microphone 14. In addition, pop filter 10 is provided with multiple airfoil surfaces, e.g., surfaces 26, 28, that are oriented non-orthogonally relative to an axis 30 between the audio source 12 and microphone 14, more specifically between the audio source 12 and the active pickup or diaphragm 32 of the microphone 14. In one embodiment, for example, pop filter 10 may be conic in shape, with an apex 34 facing audio source 12 and a circular base 36 facing microphone 14. As will be discussed in greater detail below, however, a wide variety of alternate geometries may be used to provide the multiple airfoil surfaces in a pop filter consistent with the invention. Many of these geometries, as will become more apparent below, incorporate a single-point apex from which one or more airfoil surfaces extend.

As noted above, it is desirable for pop filter 10 to be positioned generally along axis 30 extending from the audio source 12 to the diaphragm 32 of microphone 14. Furthermore, it is desirable to separate pop filter 10 from microphone 14 such that an airspace 38 is provided between the pop filter and the microphone 14. By positioning pop filter 10 in this manner, and with multiple airfoil surfaces 26, 28 disposed between the audio source and microphone, it is believed that most if not all of the energy from plosive artifacts is effectively redirected away from microphone diaphragm 14 such that the plosive artifacts are attenuated or even eliminated from the signal that ultimately reaches microphone 14. In addition, unlike hoop type pop filters, which are prone to being positioned too closely to a microphone or bumped into a microphone by a vocalist during a performance (thereby reducing or eliminating any plosive attenuation benefits that would otherwise be provided), the depth of the pop filter along axis 30 creates and maintains an inherent separation from the audio source to the microphone.

Each airfoil surface 26, 28 in pop filter 10 defines an angle A relative to axis 30, and in the illustrated embodiment, angle A is acute, and is desirably between about 15 degrees and about 75 degrees, and more desirably between about 35 degrees and about 60 degrees, such that the angle formed by opposing airfoil surfaces 26, 28 extending from apex 34 is between about 30 degrees and about 150 degrees, and more desirably between about 70 degrees and about 120 degrees. It will be appreciated that different airfoil surfaces 26, 28 may have different angles, and that individual surfaces 26, 28 may be curved such that multiple angles are defined at different points along axis 30. Desirably each surface 26, 28 has at least a portion oriented less than about 60 degrees relative to axis 30 such that the portion functions deflects, rather than transmits, plosives.

Figure 2:
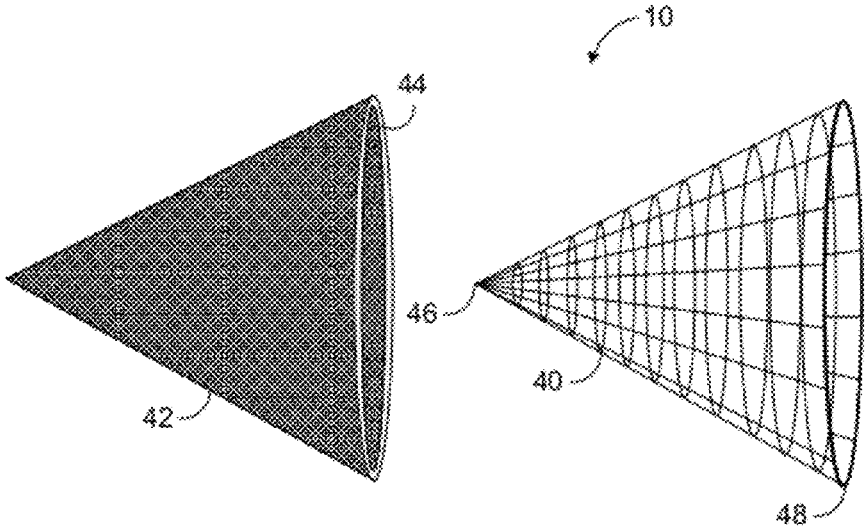
FIG. 2 is an exploded perspective view of one implementation of a pop filter consistent with the invention.

Pop filter 10 may be constructed in a number of manners consistent with the invention. For example, FIG. 2 illustrates one suitable construction of pop filter 10, utilizing a wire frame support structure 40 and a substantially acoustically transparent material 42. In this implementation, material 42 is an elastic fabric such as spandex, although a wide variety of alternate materials may be used. For example, other substantially acoustically transparent fabrics, whether elastic or inelastic, such as Lycra®, nylon, hosiery material, speaker cloth, spandex, elastane, elaspan, etc. may be used in the alternative.

Material 42 is configured to be stretched over support structure 40, and includes a hem 44, formed, e.g., by sewing, that retains the material on the support structure. As such, material 42 may or may not have a conical shape when not stretched over support structure 40, as the flexible and elastic nature of the material permits the material to assume the shape of the support structure. In addition, it will be appreciated that the material 42 may extend over only a portion of the opening formed by base 48 of support structure 40, or may extend completely over the base. In other embodiments, no material 42 may cover the plane of the base.

Support structure 40, in this embodiment, is formed of a wire frame constructed of various materials, e.g., various metals or plastics, and includes suitable structural support to retain material 42 in a desired shape, without appreciably blocking the transmission of sound through the support structure (i.e., the support structure is also substantially acoustically transparent). Support structure 40, as noted above, is conic in shape and includes an apex 46 and circular base 48.

In addition, a portion of support structure 40 may be configured to receive clamp 22 of mount 16. Clamp 22 (not shown in FIG. 2) may be coupled to support structure 40 proximate base 48, proximate apex 46 or at any point therebetween. In addition, various mechanisms may be used to otherwise secure support structure 40 to a gooseneck or other arm, e.g., a threaded bolt and cooperative threaded aperture, a knurled or wing nut or a fixed threaded bolt or machine screw on the support structure, an eye on a fitting that screwed onto an arm/gooseneck and a bolt or wing nut affixing the two together, or in other manners that would be apparent to one of ordinary skill in the art having the benefit of the instant disclosure.

Figure 3:
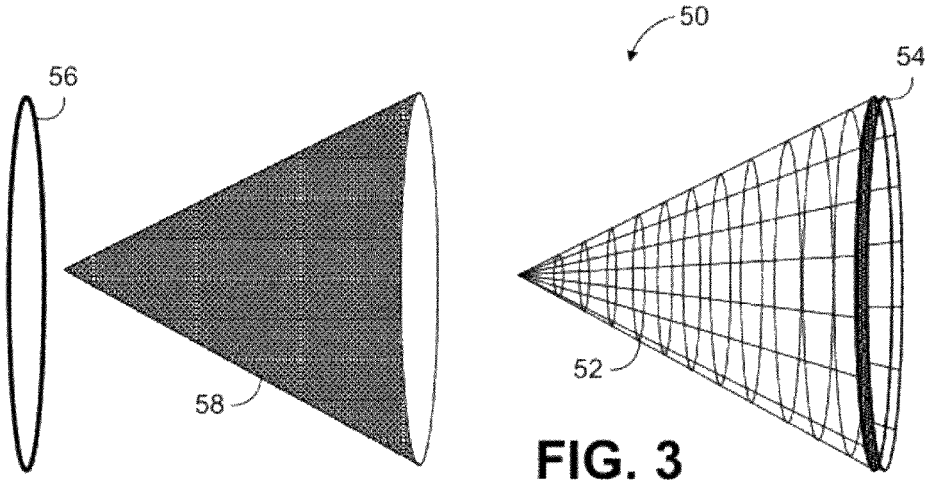
FIG. 3 is an exploded perspective view of an alternate implementation of a pop filter to that of FIG. 2, utilizing a retaining band to secure a fabric sleeve to a support structure.

As noted above, a number of different construction techniques may be used to fabricate a pop filter consistent with the invention. For example, FIG. 3 illustrates an alternate pop filter 50 incorporating a wire frame support structure 52 that incorporates a circumferential groove or channel 54 proximate the base thereof for receiving a retaining band or ring 56, e.g., a rubber or elastic band. A substantially acoustically transparent material 58 is stretched over support structure 52 and held in place between retaining band or ring 56 and channel 54.

Figure 4:
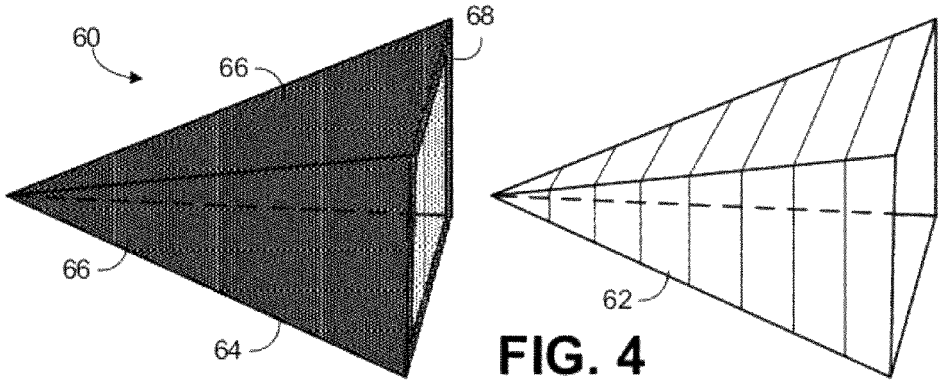
FIG. 4 is an exploded perspective view of another alternate implementation of a pop filter to that of FIG. 2, utilizing sewn panels and a pyramidic support structure.

As another example, FIG. 4 illustrates a pop filter 60 that incorporates a pyramidic wire frame support structure 62 incorporating a square base. A substantially acoustically transparent material 64 in this embodiment is formed from four sewn panels 66 of an elastic fabric such as spandex, and with a hem 68 similar to that used on material 42 of FIG. 2. In this configuration, the airfoil surfaces are planar in nature, unlike in the conic embodiments of the invention, where the airfoil surfaces are curved, and in many instances, different portions of a common curved surface.

Figure 5:
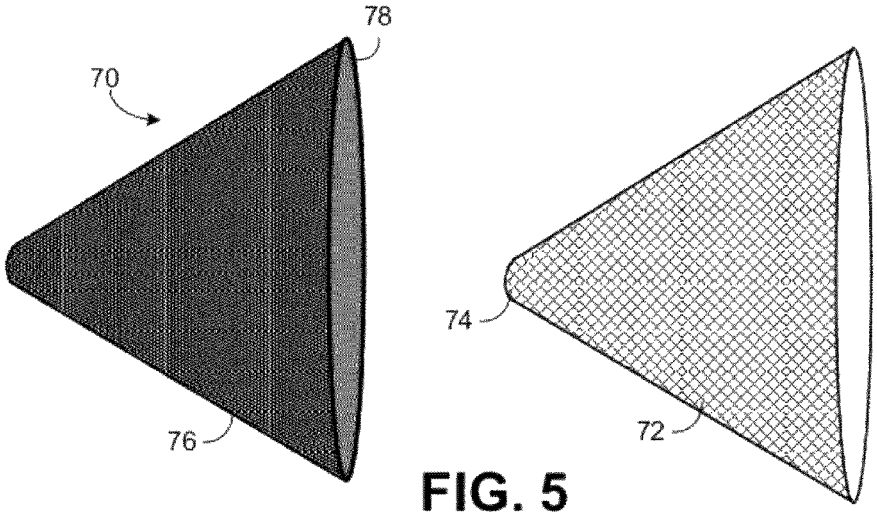
FIG. 5 is an exploded perspective view of yet another alternate implementation of a pop filter to that of FIG. 2, utilizing a support structure with a rounded apex and formed of a wire mesh material.

As yet another example, FIG. 5 illustrates a pop filter 70 that incorporates a wire mesh support structure 72, formed of a metallic wire mesh material such as hardware cloth or screening material. Support structure 72 also differs from the other designs described above in that a rounded apex 74 is defined on the support structure. Furthermore, a substantially acoustically transparent material 76 in this embodiment incorporates an additional flat base panel 78 to illustrate that in certain embodiments, the base of a pop filter need not be open. The base panel may be planar, and thus similar to a conventional hoop-type pop filter, or may have other geometries, e.g. curved or even incorporating one or more airfoil surfaces that are non-orthogonal to the axis between an audio source and a microphone diaphragm, thus essentially providing an integrated dual pop filter design.

It will be appreciated that a wide variety of alternate construction techniques may be used to fabricate a pop filter consistent with the invention. For example, a rigid acoustically transparent material may be fabricated to incorporate any of the geometries described herein, thereby eliminating the need for a separate structure. As another alternative, the supporting frame material may be of a nature such that the material of the frame itself acts as a deflective surface, which still being acoustically transparent, obviating the need for covering, fabric or otherwise. Therefore, the invention is not limited to the particular construction techniques disclosed herein.

Furthermore, as noted above, pop filters consistent with the invention may incorporate various geometries to provide multiple airfoil surfaces for the purpose of attenuating plosive artifacts.

Figure 6:
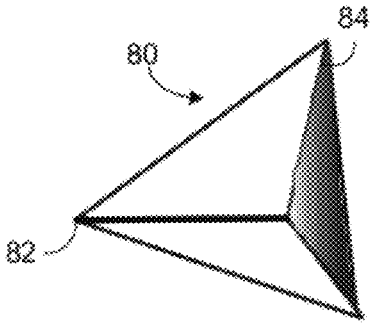
FIG. 6 is a perspective view of a pyramidic shaped pop filter with a triangular base and consistent with the invention.
Figure 7:
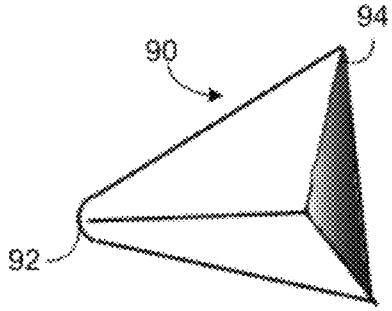
FIG. 7 is a perspective view of an alternate implementation of a pyramidic shaped pop filter to that of FIG. 6, incorporating a rounded apex.

FIG. 6, for example, illustrates a pop filter 80 that incorporates a pyramidic shape with a pointed apex 82 and triangular base 84, while FIG. 7 illustrates a pop filter 90 that incorporates a pyramidic shape with a rounded apex 92 and triangular base 94.

Figure 8:
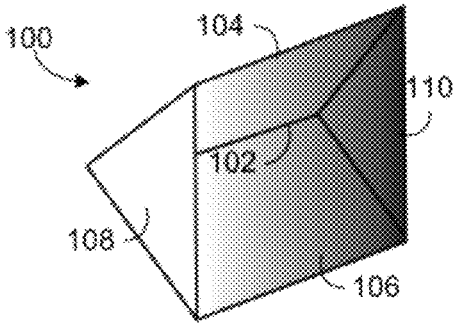
FIG. 8 is a perspective view of a V-shaped pop filter consistent with the invention.
Figure 9:
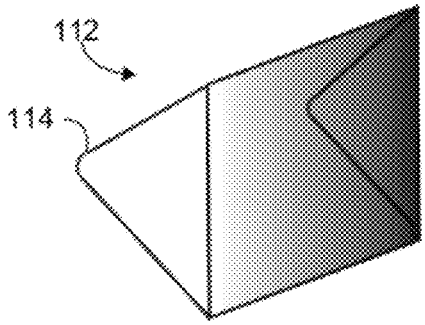
FIG. 9 is a perspective view of an alternate implementation of a V-shaped pop filter to that of FIG. 8, incorporating a rounded leading edge.

FIG. 8 illustrates a V-shaped pop filter 100 that, instead of incorporating a conic or pyramidic shape with an apex that converges at a single point, includes a convex polyhedron shape that includes a leading edge 102 joining first and second rectangular faces 104, 106, and with first and second triangular faces 108, 110, each joined to respective end edges of the first and second rectangular faces 104, 106. FIG. 9 illustrates another V-shaped pop filter 112 that is similar to pop filter 100, but includes a rounded leading edge 114.

Figure 10:
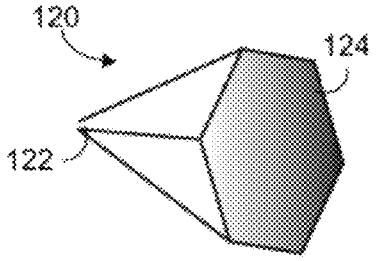
FIG. 10 is a perspective view of a pyramidic shaped pop filter with a hexagonal base and consistent with the invention.
Figure 11:
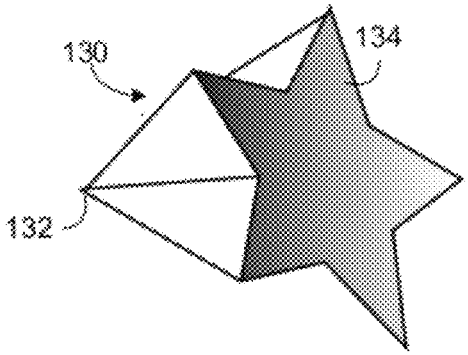
FIG. 11 is a perspective view of a pyramidic shaped pop filter with a star-shaped base and consistent with the invention.

FIG. 10 illustrates a pyramidic shaped pop filter 120 with an apex 122 and a hexagonal base 124, while FIG. 11 illustrates a pyramidic shaped pop filter 130 with an apex 132 and a ten sided, star shaped base 134. As will be appreciated, any number of distinct airfoil surfaces may be defined on a pop filter consistent with the invention.

Other geometric shapes may be used for a pop filter consistent with the invention. Therefore the invention is not limited to the shapes disclosed herein.

Figure 12:
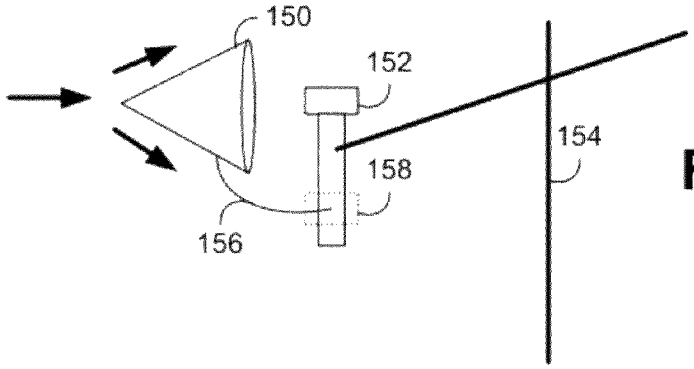
FIG. 12 is a functional diagram illustrating one implementation of a pop filter suitable for use with a side-address microphone.
Figure 13:
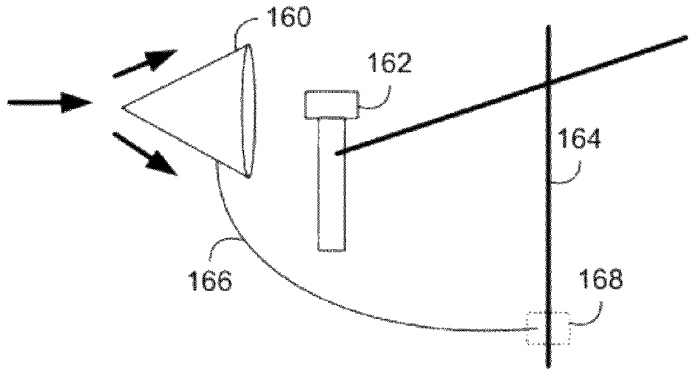
FIG. 13 is a functional diagram illustrating an alternate implementation of a pop filter suitable for use with a side-address microphone.

As noted above, a pop filter may be secured in position between an audio source and a microphone in a number of manners consistent with the invention. FIG. 12, for example, illustrates a pop filter 150 for use with a side-address microphone 152 mounted on a microphone stand 154. Pop filter 150 is secured via a fixed, articulated or flexible arm 156 to a clamp 158 mounted directly on microphone 152. Clamp 158, for example, may be a spring clamp or a screw-tightened clamp, among other designs. Alternatively, as illustrated in FIG. 13, a pop filter 160 may be secured in position relative to a side-address microphone 162 by securing the pop filter directly to a stand 164 via an arm 166 and clamp 168.

Figure 14:
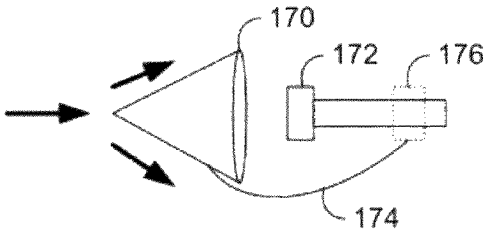
FIG. 14 is a functional diagram illustrating one implementation of a pop filter suitable for use with a top-address microphone.
Figure 15:
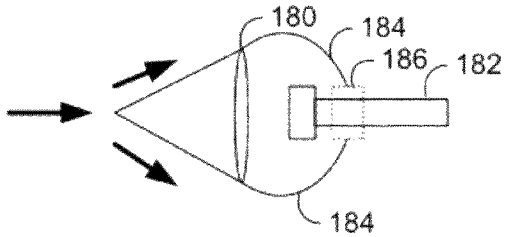
FIG. 15 is a functional diagram illustrating another implementation of a pop filter suitable for use with a top-address microphone.

In other embodiments, a pop filter may be secured to other types of microphones, e.g., top-address microphones, as well as to microphones used in other applications such as handheld, camera-mounted, etc. FIG. 14, for example, illustrates a pop filter 170 for use with a handheld, top-address microphone 172, and connected thereto by a single, fixed, articulated or flexible connecting arm 174 mounted to a clamp 176. Clamp 176 may be a spring clamp or screw-tightened clamp or may be formed from an expandable flexible material (e.g., plastic or rubber) collar. As another alternative, as illustrated in FIG. 15, a pop filter 180 may be secured to a microphone 182 via multiple arms 184 coupled to a collar or clamp 186.

Figure 16A:
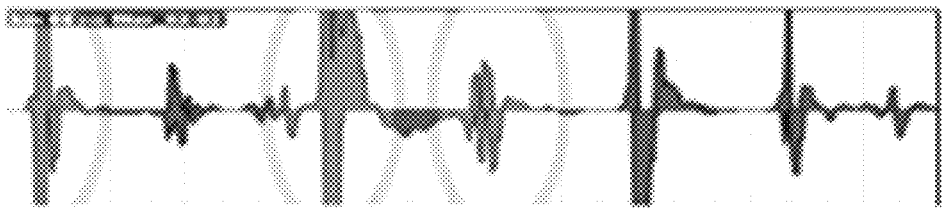
FIGS. 16A-16D are graphs comparing the attenuation of plosives between a microphone with no pop filter (FIG. 16A), with a conventional planar pop filter (FIG. 16B), a two inch deep pop filter consistent with the invention (FIG. 16C) and a four inch deep pop filter consistent with the invention (FIG. 16D).
Figure 16B:
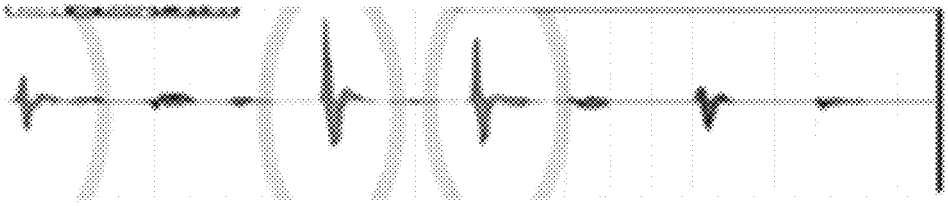
Figure 16C:
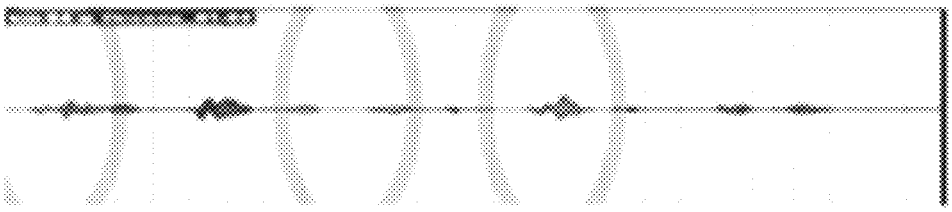
Figure 16D:
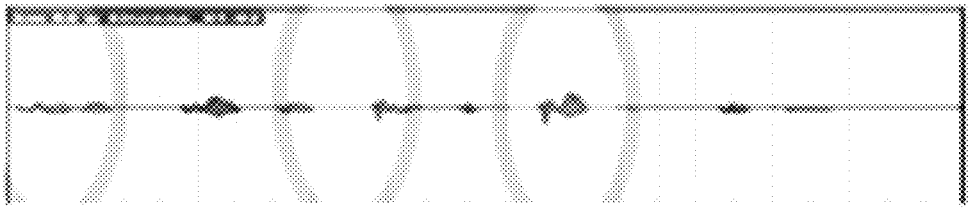

FIGS. 16A-16D illustrate the plosive attenuation capabilities of pop filters consistent with the invention, FIG. 16A, for example, illustrates an exemplary waveform recorded for the spoken phrase "Peter Piper picked a peck of pickled peppers," spoken into a Neumann KM84 microphone at a distance of about six inches, and without the use of a pop filter between the speaker and the microphone. The three circled areas in the graph highlight plosive artifacts corresponding generally to the terms "Peter," "picked," and "peck." FIG. 16B illustrates the waveform recorded from the microphone using the same spoken phrase, but with a conventional, planar or hoop-style pop filter placed in front of the microphone. The plosive artifacts are attenuated somewhat by the planar screen; however, substantial negative audio artifacts, which remain audible, still remain. In contrast, FIGS. 16C and 16D respectively illustrates waveforms recorded by the same microphone using the same spoken phrase, but with conical pop filters consistent with the invention placed in front of the microphone. The pop filter used in FIG. 16C was two inches deep, providing an angle A relative to the axis of about 45 degrees. The pop filter used in FIG. 16D was four inches deep, providing an angle A relative to the axis of about 28 degrees. Notably, the plosive artifacts are substantially reduced relative to both the bare microphone (FIG. 16A) and the planar pop filter (FIG. 16B), thereby providing substantially improved attenuation of these negative audio artifacts.

Figure 17A:
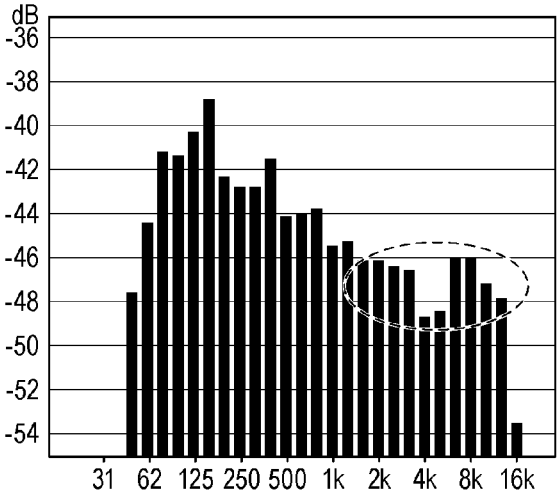
FIGS. 17A-17C are graphs illustrating the frequency response of pink noise played back through a microphone with no pop filter (FIG. 17A), with a six inch deep pop filter consistent with the invention (FIG. 17B), and with a three inch deep pop filter consistent with the invention (FIG. 17C).
Figure 17B:
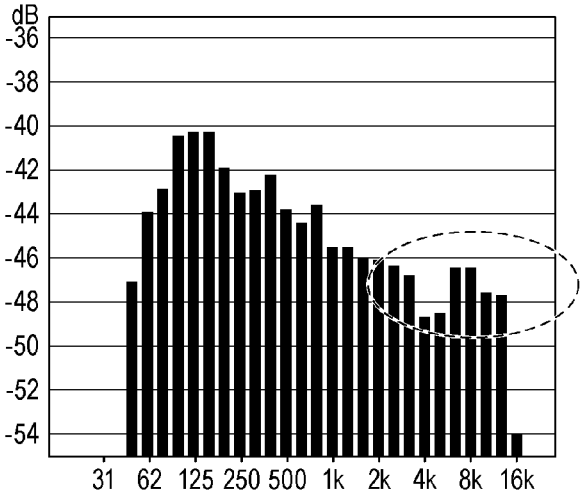
Figure 17C:
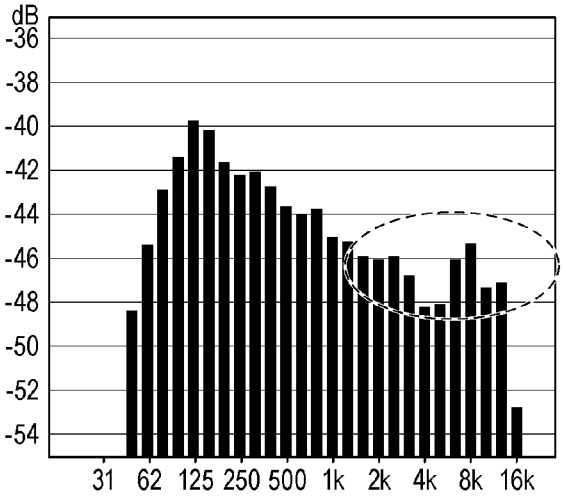

It should also be noted that embodiments consistent with the invention are also capable of attenuating plosive artifacts with minimal affect on fidelity. FIGS. 17A-17C, for example, illustrate frequency response graphs showing the representation of pink noise played through a control microphone at a distance of about 1 foot. FIG. 17A shows the response with no pop filter, FIG. 17B shows the response with a six inch deep conical pop filter, and FIG. 17C shows the response with a three inch deep conical pop filter. The highlighted area on the graphs illustrate crucial high frequency components of the pink noise, and can be seen from these figures, the effect of the conical pop filters on the high frequencies (as well as all other frequencies) is negligible, in all cases less than about 1 decibel deviation.

Various additional modifications may be made without departing from the spirit and scope of the invention. For example, airfoil surfaces may be planar or curved or a combination thereof, an apex may be pointed or rounded, and a pop filter may be formed with a constant curve throughout. In addition, a pop filter may include multiple apexes and multiple associated airfoil surfaces, thereby creating a more complex design.

Other modifications will be apparent to one of ordinary skill in the art. Therefore, the invention lies in the claims hereinafter appended.

What is claimed is:

1. A microphone pop filter for attenuating plosive artifacts from an audio source, comprising:

a substantially acoustically transparent material configured in use to be disposed intermediate the audio source and a microphone diaphragm and spaced away from the microphone diaphragm so as to provide an airspace therebetween; and at least two airfoil surfaces defined by at least two portions of the substantially acoustically transparent material, each airfoil surface oriented non-orthogonally relative to an axis defined between the audio source and the microphone diaphragm to deflect plosive artifacts from the audio source away from the microphone diaphragm, wherein each of the first and second airfoil surfaces includes a portion that is oriented at an angle of less than about 60 degrees relative to the axis from the audio source to the microphone diaphragm such that the portion deflects, rather than transmits the plosive artifacts.

2. The microphone pop filter of claim 1, further comprising a substantially conic support structure, wherein the substantially acoustically transparent material is disposed on the substantially conic support structure.

3. The microphone pop filter of claim 2, wherein the substantially conic support structure includes an apex and defines an opening opposite the apex, and wherein the substantially acoustically transparent material does not cover at least a portion of the opening.

4. The microphone pop filter of claim 3, wherein the substantially acoustically transparent material is elastic and includes an elastic hem configured to retain the substantially acoustically transparent material on the conic support structure.

5. The microphone pop filter of claim 3, further comprising a retaining ring configured to retain the substantially acoustically transparent material on the conic support structure.

6. The microphone pop filter of claim 2, wherein at least a portion of the substantially acoustically transparent material covers a base of the conic support structure.

7. The microphone pop filter of claim 2, wherein the substantially conic support structure is pyramidic and each of the at least two airfoil surfaces is planar.

8. The microphone pop filter of claim 2, wherein the at least two airfoil surfaces are defined along a common curved surface.

9. The microphone pop filter of claim 2, wherein the substantially conic support structure comprises a wire frame.

10. The microphone pop filter of claim 1, further comprising a mount coupled to the conic support structure and configured to orient the conic support structure in a spaced away arrangement relative to the microphone diagram with an apex of the conic support structure facing the audio source.

11. The microphone pop filter of claim 10, wherein the mount comprises a gooseneck mount.

12. The microphone pop filter of claim 1, wherein at least a portion of the substantially acoustically transparent material is arranged in a conic shape, and wherein the at least two airfoil surfaces are defined on at least one surface of the conic shape.

13. The microphone pop filter of claim 12, wherein the conic shape is pyramidic.

14. The microphone pop filter of claim 13, wherein the at least two airfoil surfaces comprise a number of planar surfaces, wherein the number is selected from the group consisting of three, four, six and ten.

15. The microphone pop filter of claim 12, wherein the conic shape includes a rounded apex.

16. The microphone pop filter of claim 1, wherein at least a portion of the substantially acoustically transparent material is arranged in a convex polyhedron shape comprising first and second rectangular faces joined along leading edges thereof and first and second triangular faces, each joined to respective end edges of the first and second rectangular faces.

17. The microphone pop filter of claim 16, wherein the leading edge of the polyhedron shape is rounded.

18. The microphone pop filter of claim 1, wherein the substantially acoustically transparent material comprises a spandex fabric.

19. The microphone pop filter of claim 1, wherein each of the first and second airfoil surfaces is oriented at an acute angle relative to the axis from the audio source to the microphone diaphragm, and wherein the acute angle for the first airfoil surface is between about 15 degrees and about 75 degrees.

20. The microphone pop filter of claim 19, wherein the acute angle for the first airfoil surface is between about 35 degrees and about 60 degrees.

21. A microphone pop filter, comprising:

a substantially acoustically transparent material supported by a support structure to define at least one generally conic airfoil surface extending along an axis from an apex of the conic airfoil surface to a base thereof, wherein the conic airfoil surface is oriented at an angle of less than about 60 degrees relative to the axis from the apex to the base thereof; and a mount coupled to the support structure and configured to orient the substantially acoustically transparent material intermediate the audio source and a microphone diaphragm with the apex facing the audio source, the mount further configured to orient the substantially acoustically transparent material spaced away from the microphone diaphragm so as to provide an airspace therebetween.

22. The microphone pop filter of claim 21, wherein the mount comprises a gooseneck mount.

23. The microphone pop filter of claim 21, wherein the support structure comprises a wire frame and wherein the substantially acoustically transparent material comprises a spandex fabric.

24. The microphone pop filter of claim 21, wherein the support structure is pyramidic.

25. The microphone pop filter of claim 21, wherein the support structure includes a rounded apex.

* * * * *